US005381934A

United States Patent [19]

Ueberegger

[11] Patent Number: 5,381,934

[45] Date of Patent: Jan. 17, 1995

[54] TUBE CLOSURE

[75] Inventor: Heinrich Ueberegger, Baretswil, Switzerland

[73] Assignee: Combitool AG, Baretswil, Switzerland

[21] Appl. No.: 170,216

[22] PCT Filed: Apr. 20, 1993

[86] PCT No.: PCT/CH93/00104

§ 371 Date: Mar. 7, 1994

§ 102(e) Date: Mar. 7, 1994

[87] PCT Pub. No.: WO93/22213

PCT Pub. Date: Nov. 11, 1993

[30] Foreign Application Priority Data

Apr. 28, 1992 [CH] Switzerland ..... 01356/92

[51] Int. Cl.[6] ..... B67D 3/00

[52] U.S. Cl. ..... 222/536; 222/548; 220/253

[58] Field of Search ..... 222/153, 149, 513, 516, 222/532, 536, 486, 548; 220/253

[56] References Cited

U.S. PATENT DOCUMENTS

| | | | |
|---|---|---|---|
| 2,780,395 | 2/1957 | Schlabach et al. | 222/548 |
| 3,104,039 | 9/1963 | Dike | 222/536 |
| 3,261,516 | 7/1966 | Allen | 222/548 |
| 3,447,725 | 6/1969 | Armour | 222/486 |
| 3,563,368 | 2/1971 | McHugh | 220/253 |
| 4,444,328 | 4/1984 | Glass | 222/548 |
| 4,488,668 | 12/1984 | Flaska et al. | 222/548 |

FOREIGN PATENT DOCUMENTS

| | | | |
|---|---|---|---|
| 1548054 | 11/1968 | France . | |
| 9206097 | 8/1992 | Germany . | |
| 246167 | 6/1925 | United Kingdom | 222/548 |

*Primary Examiner*—Andres Kashnikow
*Assistant Examiner*—Philippe Derakshani
*Attorney, Agent, or Firm*—Johnson & Wortley

[57] ABSTRACT

A closure for a tube which need not be removed for releasing the contents of the tube associated with an original condition protection means. A closure cap is provided and mounted upon the tube in rotational engagement therewith and it contains an opening which may be aligned in a registry with the opening of the tube to allow the dispensing of the contents thereof.

12 Claims, 3 Drawing Sheets

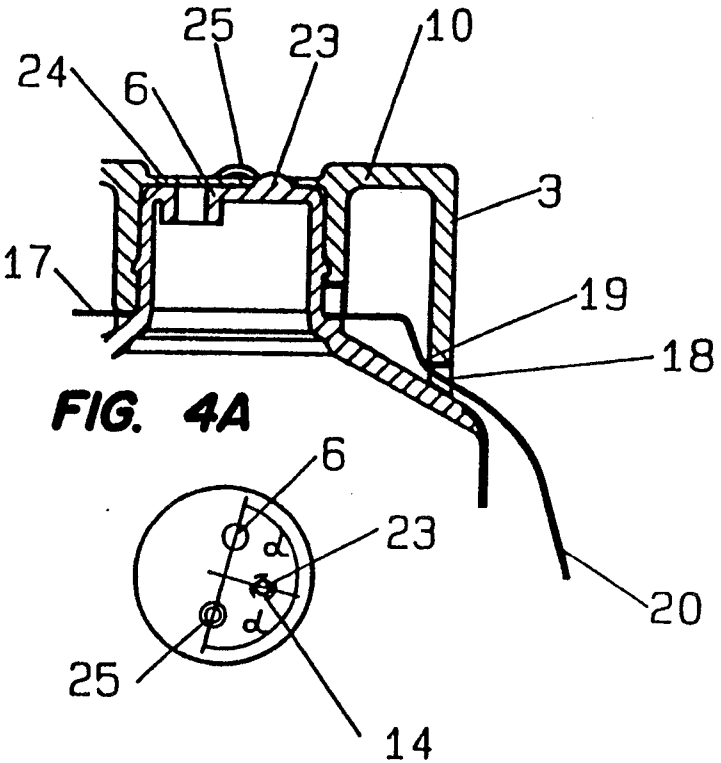
FIG. 4A
FIG. 4B
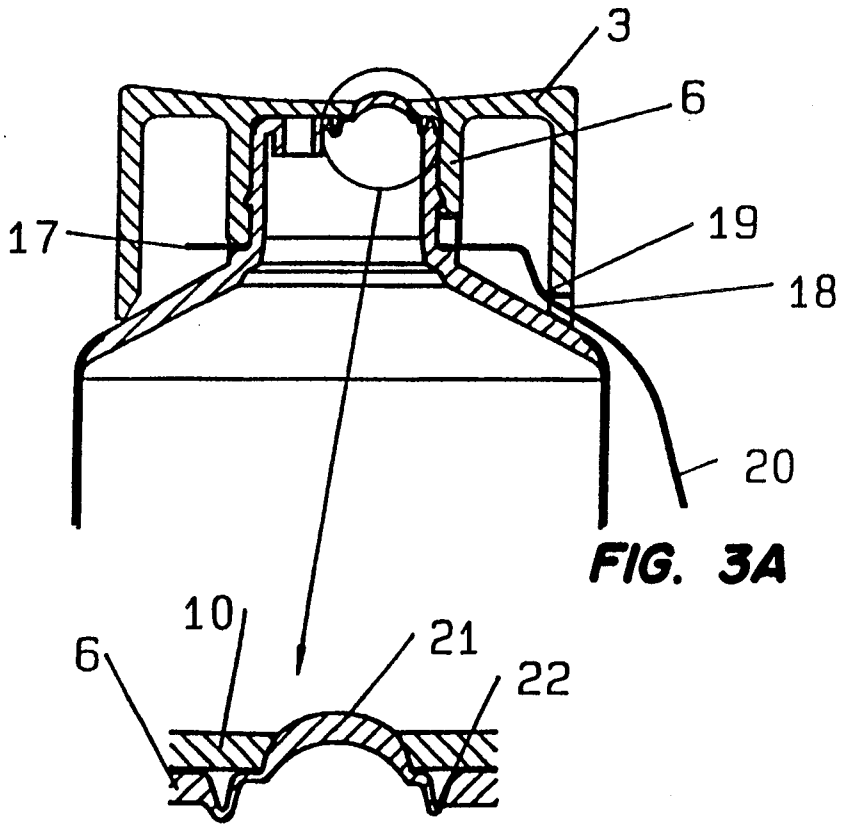
FIG. 3A
FIG. 3B

TUBE CLOSURE

BACKGROUND OF THE INVENTION

1. Field of the Invention

The present invention relates to closures for tubes and, more particularly, to a tube closure using a spherical element.

2. History of the Prior Art

There are many known closures or closure caps for tubes or similar containers with original condition protection means, such as, for example, the following patents: EP A2 460 557 and EP A1 459 941. Further, there are known tube closures which need not be completely unscrewed or pulled off in order to enable the content of the tube to be squeezed out. In the case of such known solutions, the closure, which has a hole in the center, is screwed on by one or more rotations. In doing so, the edge of said hole lifts off a pin, which closes it after it is screwed on. This opens an annular gap through which the contents of the tube, or of the container in general, runs out or is actively squeezed out.

If only small quantities were to be taken from the tube, then this solution was not found to be acceptable because, in the case of a salve or a cream exiting from an annular opening a tube forms having a shape of little stability and, therefore, permitting no clear determination as to the amount having exited. The disadvantage of most of the known closures intended to preserve the original condition, (the two cited European patent applications are representative for a large number of similar solutions ), lies mainly in their spatial complexity. Some of them provide predetermined rupture links of a sometimes very complex nature, and some require that original condition protection strings are torn or stretched, making it necessary to assemble the closure from several very complicated parts. This requires either several or very complicated molded parts, which make the product expensive. The problem to be solved with the present invention is the creation of a closure for tubes or soft plastic bottles, which needs not be fully unscrewed to allow the contents to be squeezed out, and which can be connected in a simple way with a closure preserving the original condition.

SUMMARY OF THE INVENTION

The present invention relates to a tube closure. More particularly, one aspect of the invention relates to a closure for a tube which need not be removed for releasing the contents of the tube. The tube is formed with a shoulder which becomes narrower in the direction of the tube neck to which shoulder in the region neck has a cam attached. The tube neck has an exterior collar which is closed at its face except for an eccentrically disposed opening. In the face of the tube neck a member consisting of at least one spherical segment is present, which is displaced relative to the opening by a predetermined angle. A closure cap is utilized and the closure cap is divided into an inner cylindrical part, an exterior, essentially cylindrical part, and an upper closure plate. An angular groove and collar are shaped in such a way that the closure cap can be pressed over the tube neck, thus stretching the inner cylindrical part of the closure cap. The closure plate contains an opening which, in one position of the closure cap, will be located above the member which consists of at least one spherical element and which is shaped in such a way that it is closed by this member and then a closure plate has at the lower edge of its essentially cylindrical portion a recess which, by means of the cam, is positioned at the shoulder and which is so wide that the closure cap can be turned through an angle while the cam limits its rotation in either side.

BRIEF DESCRIPTION OF THE DRAWINGS

For a more complete understanding of the present invention and for further objectives and advantages thereof, reference may now be had to the following detailed description when taken in conjunction with the accompanying drawings herein:

FIGS. 3*a* and 3*b* illustrate a second embodiment of the present invention shown as a section and a plan view; and FIGS. 4*a* and 4*b* illustrate a third embodiment of the present invention shown as a section.

DETAILED DESCRIPTION

Figure 1B:
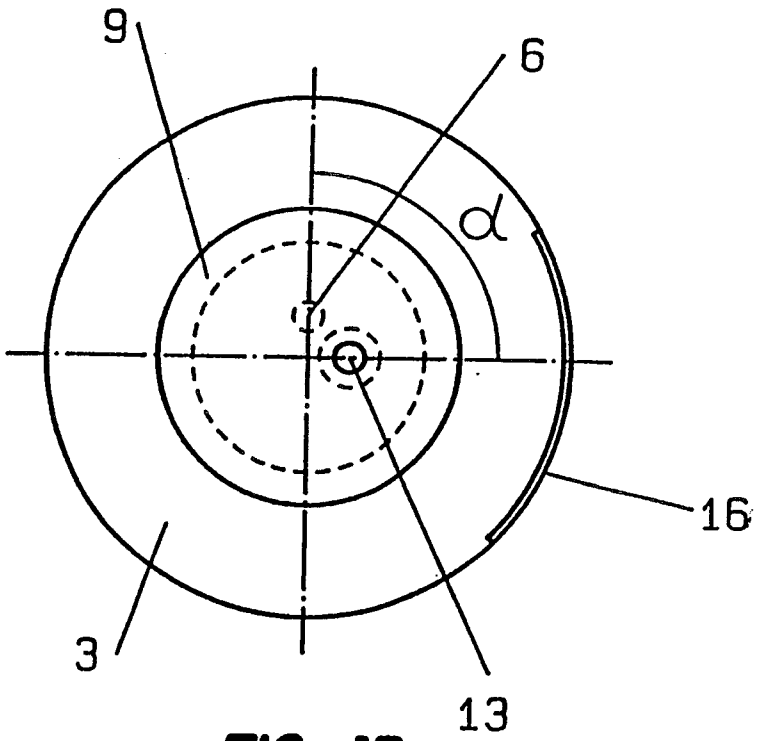
FIGS. 1*a* and 1*b* illustrate a first embodiment of the present invention shown as a cross section in FIG. 1*a* and a top plan view in FIG. 1*b;*
Figure 1A:
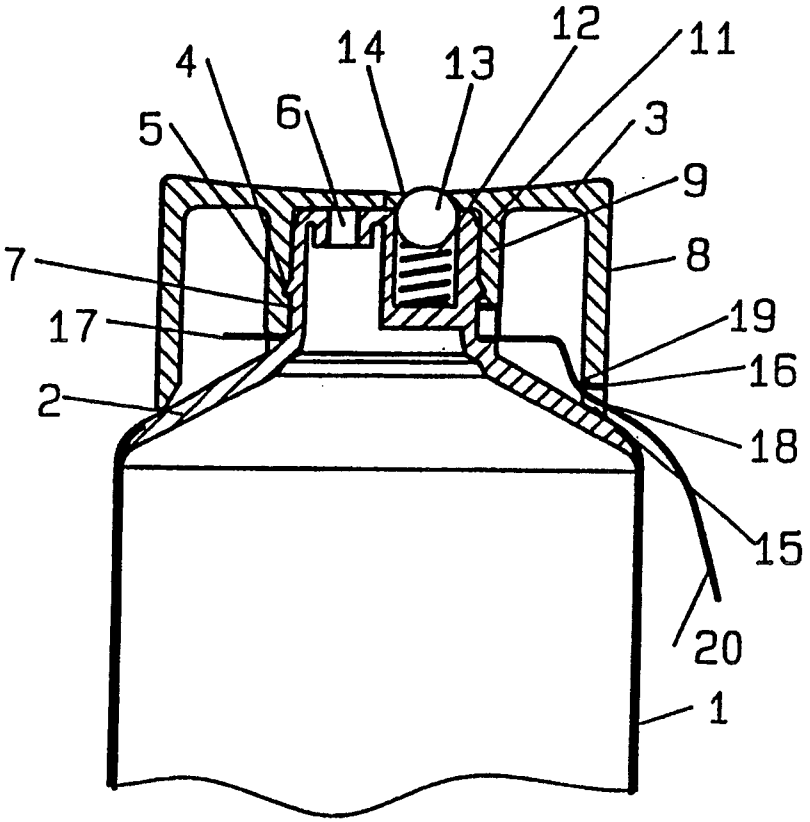

The first embodiment is shown in FIG. 1*a* as a side elevational, cross section of the invention and in FIG. 1*b* as a top plan view thereof. The tube body 1 has joined to it, for example, by welding—a shoulder 2 which narrows toward the top into a tube neck 7. The tube neck 7 has a collar 4. A closure cap 3 is divided into outer and inner concentric cylindrical parts 8 and 9, respectively, and a closure plate 10. The inner cylindrical part 9 fits with limited clearance onto tube neck 7 and contains an annular groove 5. Collar 4 and annular groove 5 are shaped in such a way that closure cap 3 can be readily—by stretching interior cylindrical portion 9—pushed upon the neck of tube 7 so that a removal of closure cap 3 is no longer possible without destroying it. Tube neck 7 is closed except for an eccentrically located opening 6. In the position shown of closure cap 3, opening 6 of closure plate 10 can be tightly closed. Naturally, the external configuration of closure cap 3 need not be of the shape shown, but can be given, relative to closure plate 10, a planar, convex or concave shape; further, the transition of closure plate 10 to outer cylindrical part 8 can be a gradual one; also, outer cylindrical part 8 need not have a truly cylindrical shape: polygonal shapes are just as conceivable, making it a question of taste rather than a technical one.

In tube neck 7 there is, also eccentrically positioned, offset by an angle relative to opening 6, but at the same distance from the axis of tube neck 7. Integrally molded to the tube neck 7 is a cylinder 11 which is closed at the bottom and open at the top and which contains a ball 13 pushed toward the top by a helical spring 12. Ball 13 is movable in cylinder 11 with some clearance and closes—in the position according to FIGS. 1*a* and 1*b*—an opening 14 in closure cap 3[, which]. The opening 14 preferably has the shape of segmented spherical shells.

If a portion of the contents of the tube is to be removed, then closure cap 3 is rotated by an angle $\alpha$. At the same time, closure plate 10 pushes ball 13 downward against the resistance of helical spring 12; opening 13 in closure cap 3 winds up resting upon opening 6; and the content of the tube can be removed. After it is rotated back to the original position according to FIGS. 1*a* and 1*b*, ball 13 once again closes opening 14, and remaining portions of the content of the tube can be cleanly removed from the ball with one's finger.

The restriction of the rotatability of closure cap 3 to the selected angle $\alpha$ is effected by the joint action of a cam 15, which is formed as a part of shoulder 2, and a lateral recess 16 at the outer cylindrical portion 8 of closure cap 3. Recess 16 is thus wide enough that, in view of the width of cam 15, it permits rotation of screw cap 3 through angle $\alpha$. The parts designated by numbers 17 to 20 will be explained in connection with FIG. 2.

Figure 2:
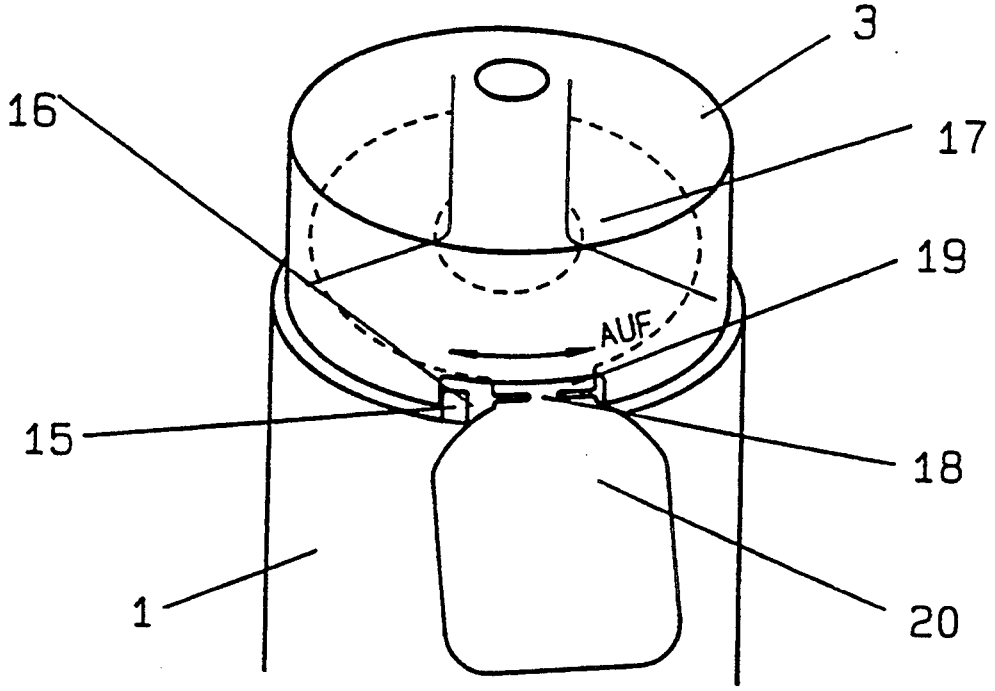
FIG. 2 illustrates a phantom presentation of the first embodiment of the present invention.

Referring now to FIG. 2, there is shown a phantom view in perspective of the embodiment according to FIGS. 1*a* and 1*b*. In the cavity between shoulder 2 and cylindrical parts 8 and 9 of FIG. 1*a*, a ring 17 has been inserted. The ring 17 is connected by means of a strip 19 and an intended rupture link 18 to a piece of cloth 20 located outside closure cap 3. Rupture link 18 lies immediately inside recess 16. The dimensions of the piece of cloth 20 are greater than the width of recess 16. The thickness of the material of this original condition protection means, consisting of the parts numbered from 17 to 20, corresponds preferably to the height of recess 16. Piece of cloth 20 can, for example, be marked with the price, product information and the date after which it should not be used. The closure cap 3 cannot be turned without tearing off the rupture link 18, and the closure cap 3 cannot be severed from the tube without the use of force and the destruction of the closure cap 3.

The embodiment described has the effect that strip 19, after piece of cloth 20 is torn off—thus after damaging the original condition protection means—does not hinder the rotation of closure cap 3. Further, it is not possible to push piece of cloth 20 back into recess 16 in order to feign an intact original condition.

In an alternative to FIG. 2 not shown, ring 17 is so large that rupture link 18 is positioned between the outer edge of ring 17 and piece of cloth 20 removing the need for the strip 19.

The original condition protection means shown in FIG. 2 is preferably made of cardboard. This permits cost-effective manufacturing, printing on it without problems and easy integration during the closure process.

Referring now to FIG. 3*a* and FIG. 3*b*, there is shown a second embodiment of the present invention. In the place of ball 13 of FIG. 1, there is now a spherical part 21, which is connected at its face to the end of tube neck 7 by way of an annular spring link 22, produced in the same injection mold. The other parts and configurations correspond to those of FIGS. 1 and 2. When turning closure cap 3, spherical part 21 is pressed downward against yielding spring link 22.

Parts 17 to 20 which make up the original condition protection means, are the same in FIGS. 3*a* and 3*b* as in FIGS. 4*a* and 4*b*, and are not described any further.

A further embodiment is shown in FIGS. 4*a* and 4*b*. Here, the end of tube neck 7 has at its face, without any reduction of wall thickness, a protrusion in the form of spherical segment 23. Closure plate 10 is thinner at its central portion 24 than the rest of closure plate 10. When closure cap 3 is turned, then closure plate 10, in region 24, is displaced toward the top until spherical segment 23 snaps into a spherical recess 25 in region 24 of closure plate 10. This recess 25 is also displaced by an angle $\alpha$ relative to opening 14 in closure cap 3, so that spherical segment 23 snaps into place in recess 25 while closure cap 3 is in the same position as during the release of opening 6 in tube neck 7 through opening 14 in closure cap 3.

The advantages of the embodiments described are primarily that the tube provided with the closure according to the invention remains essentially closed. The small remainder of the contents of the tube which remains in opening 14 of closure cap 3 after the quantity that was squeezed out, for example, was removed with a finger, is extruded after closure cap 3 was turned back, by ball 13, spherical segment 21 or spherical part 23 from opening 14, and can be wiped off. No unhygienic and unappetizing agglomerations of dried-out or spoilt contents of the tube accumulate either at the opening of the tube or at the cover of the tube; furthermore, the contents of the tube can neither be contaminated nor dry out. Because no cover is removed, it cannot be put away or lost, nor can it fall to the floor. Neither the content of the tube nor the interior of the cover can ever come in contact with contaminants. This is of special importance, because the longer it is, the more preservative and bacteriostatic additives to the tube contents can be dispensed with.

By adaptation of the size of opening 14 and ball 13 closing it, or spherical parts 21, 23, the tube closure in accordance with the invention is suitable for any application or contents.

It is thus believed that the operation and construction of the present invention will be apparent from the foregoing description. While the method and apparatus shown or described has been characterized as being preferred, it will be obvious that various changes and modifications may be made therein without departing from the spirit and scope of the invention as defined in the following claims.

What is claimed:

1. A device for the closure of a tube having a shoulder connected to a tube neck, said tube neck having an opening disposed at a select eccentric distance from the center of the tube neck, said device comprising:

a cam attached to said shoulder of said tube;

an exterior collar disposed around the outside of said tube neck;

a closure cap including:

an inner cylindrical part having an annular groove, said inner cylindrical part rotatably engaging said tube neck and said annular groove of said inner cylindrical part rotatably engaging said exterior collar, wherein said tube neck, said collar, said inner cylindrical part, and the annular groove of said inner cylindrical part are shaped such that the inner cylindrical part can be pressed over the tube neck until said collar engages the annular groove of said inner cylindrical part but said inner cylindrical part cannot be retracted from said tube neck and said collar without destroying said inner cylindrical part;

an upper closure plate attached to said inner cylindrical part and having an opening located at the same eccentric distance from the center of said tube neck as the opening in said tube neck; and an outer cylindrical part attached to said upper closure plate, said outer cylindrical part having a recess disposed over said cam, wherein said outer cylindrical part engages said cam when the opening in said upper closure plate aligns with the opening in said tube neck and when the opening in said upper closure plate is at a select rotation angle from the opening in said tube neck; and means for engaging the opening in said upper closure plate of said closure cap, said means for engaging being located on said tube neck to engage said opening in said closure cap when said opening in said closure cap is positioned at the select rotated angle from the opening in said tube neck.

2. The device according to claim 1, wherein said tube neck includes a cylindrical recess, and wherein said means for engaging includes a spring disposed in the cylindrical recess of said tube neck and which forces a ball upwardly against the upper closure plate of said closure cap, wherein said ball engages the opening in said upper closure plate of said closure cap when said opening in said closure cap is positioned at the select angle from the opening in said tube neck in which said cam contacts said outer cylindrical part of said closure cap.

3. The device according to claim 1, wherein said means for engaging comprises:

a spherical part; and an annular spring link contacting said tube neck and said spherical part, said annular spring link forcing said spherical part against said upper closure plate; and wherein said spherical part engages the opening in said upper closure plate of said closure cap when said opening in said closure cap is positioned at the select angle from the opening in said tube neck in which said cam contacts said outer cylindrical part of said closure cap.

4. The device according to claim 1, wherein said means for engaging comprises a protrusion on said tube neck, said protrusion being disposed against said upper closure plate of said closure cap, wherein said protrusion engages the opening in said upper closure plate of said closure cap when said opening in said closure cap is positioned at the select angle from the opening in said tube neck in which said cam contacts said outer cylindrical part of said closure caps, wherein said upper closure plate includes a central region which deflects when in contact with said protrusion on said tube neck, and wherein said protrusion engages a recess in said closure cap when the opening in said closure cap aligns with opening in said tube neck.

5. The device according to claim 1, 2, 3, or 4, wherein the outer surface of said upper closure plate of said closure cap is planar.

6. The device according to claim 1, 2, 3, or 4, wherein the outer surface of said upper closure plate of said closure cap is concave.

7. The device according to claim 1, 2, 3, or 4, wherein the outer surface of said upper closure plate of said closure cap is convex.

8. The device according to claim 1, 2, 3, or 4, wherein the outer surface of said outer cylindrical part of said closure cap is polygonal.

9. The device according to claim 1, 2, 3, or 4, further including an original condition protection means comprising:

a ring inserted between the inner and outer cylindrical parts of said closure cap; and a piece of cloth connected to said ring by a rupture link, wherein said piece of cloth is positioned outside said closure cap; and wherein said ring, said piece of cloth, and said rupture link have a thickness corresponding with the height of the recess in said outer cylindrical part of said closure cap.

10. The device according to claim 9, wherein said ring and said piece of cloth of said original condition protection means are cardboard.

11. The device according to claim 9, wherein said ring of original condition protection means includes a strip and said rupture link connects said piece of cloth to said strip, and wherein said strip has a thickness corresponding to the height of said recess in said outer cylindrical part of said closure cap.

12. The device according to claim 11, wherein said ring, said trip, and said piece of cloth of said original condition protection means are cardboard.

* * * * *

UNITED STATES PATENT AND TRADEMARK OFFICE

CERTIFICATE OF CORRECTION

PATENT NO. : 5,381,934

DATED : January 17, 1995

INVENTOR(S) : Heinrich Ueberegger

It is certified that error appears in the above-indentified patent and that said Letters Patent is hereby corrected as shown below:

| | |
|---|---|
| Title Page, Item [56], Foreign Patent Documents, line 3 | Delete "6/ 1925<br>Insert --1/1995-- |
| Column 2, line 59 | Delete "[, which]" |
| Column 4, line 67 | Delete "at"<br>Insert "--rotated to --;<br><br>Delete "rotation" |
| Column 5, line 5 | Delete "rotated"<br>Insert --rotation-- |
| Column 6, line 39 | Delete "trip,"<br>Insert --strip,-- |

Signed and Sealed this

Ninth Day of January, 1996

Bruce Lehman

*Attest:*

BRUCE LEHMAN

*Attesting Officer*

*Commissioner of Patents and Trademarks*